US011420789B2

(12) United States Patent
Vinke et al.

(10) Patent No.: US 11,420,789 B2
(45) Date of Patent: Aug. 23, 2022

(54) PALLET MADE OF PLASTIC HAVING REINFORCING ELEMENTS

(71) Applicant: Schoeller Allibert GmbH, Schwerin (DE)

(72) Inventors: Jan Vinke, Emmer-compascuum (NL); Patrick Breukers, Roswinkel (NL)

(73) Assignee: Schoeller Allibert GmbH, Schwerin (DE)

( * ) Notice: Subject to any disclaimer, the term of this patent is extended or adjusted under 35 U.S.C. 154(b) by 0 days.

(21) Appl. No.: 17/291,896

(22) PCT Filed: Nov. 7, 2019

(86) PCT No.: PCT/EP2019/080494

§ 371 (c)(1),
(2) Date: May 6, 2021

(87) PCT Pub. No.: WO2020/094769

PCT Pub. Date: May 14, 2020

(65) Prior Publication Data

US 2022/0002028 A1 Jan. 6, 2022

(30) Foreign Application Priority Data

Nov. 9, 2018 (DE) ..... 10 2018 128 137.4

(51) Int. Cl.
*B65D 19/00* (2006.01)
*B65D 19/18* (2006.01)

(52) U.S. Cl.
CPC ..... *B65D 19/0026* (2013.01); *B65D 19/18* (2013.01); *B65D 2519/00034* (2013.01);
(Continued)

(58) Field of Classification Search
CPC ..... B65D 19/18; B65D 2519/00034; B65D 2519/00139; B65D 2519/0074;
(Continued)

(56) References Cited

U.S. PATENT DOCUMENTS 3,348,723 A * 10/1967 Wilson ..... B65D 19/12 220/6
4,674,647 A * 6/1987 Gyenge ..... B65D 19/18 220/1.5

(Continued)

FOREIGN PATENT DOCUMENTS

DE 102009042552 A1 3/2011
DE 102014007079 A1 11/2015

(Continued)

OTHER PUBLICATIONS

European Patent Office; International Search Report; dated Jan. 7, 2020; entire document.

*Primary Examiner* — Jose V Chen
(74) *Attorney, Agent, or Firm* — Price Heneveld LLP

(57) ABSTRACT

A pallet includes a cover plate configured to accommodate articles, and at least two runners arranged underneath the cover plate, each runner including a runner standing surface, wherein each runner standing surface is subdivided centrally of each runner transversely thereto at a dividing plane and into at least two separate runner elements including a first runner element and a second runner element which, in the mounted position, combine to form the runner standing surface, and wherein each runner element includes an elongated reinforcing element which is held at a first end remote from the dividing plane by a stop in the first runner element and is held at a second end by the second runner element.

16 Claims, 6 Drawing Sheets

(52) U.S. Cl.
CPC ..... *B65D 2519/00069* (2013.01); *B65D 2519/00129* (2013.01); *B65D 2519/00139* (2013.01); *B65D 2519/00174* (2013.01); *B65D 2519/00273* (2013.01); *B65D 2519/00288* (2013.01); *B65D 2519/00323* (2013.01); *B65D 2519/00333* (2013.01); *B65D 2519/00407* (2013.01); *B65D 2519/00412* (2013.01); *B65D 2519/00442* (2013.01); *B65D 2519/00567* (2013.01); *B65D 2519/00572* (2013.01); *B65D 2519/00587* (2013.01)

(58) Field of Classification Search
CPC ..... B65D 2519/00323; B65D 2519/00333; B65D 2519/0047; B65D 2519/00412
USPC ..... 108/57.25, 56.3
See application file for complete search history.

(56) References Cited

U.S. PATENT DOCUMENTS 5,117,762 A * 6/1992 Shuert ..... B65D 19/0022 108/57.25
5,413,052 A * 5/1995 Breezer ..... B65D 19/0012 108/56.1
5,868,080 A * 2/1999 Wyler ..... B65D 19/0026 108/57.25
6,250,234 B1 * 6/2001 Apps ..... B29C 66/1142 108/57.25
6,357,366 B1 * 3/2002 Frankenberg ..... B65D 19/0026 108/57.25
8,087,364 B2 * 1/2012 Huang-Jung ..... F16B 5/065 108/56.3
8,434,618 B2 * 5/2013 Mitchell ..... B65D 19/06 206/386
8,770,115 B2 * 7/2014 Apps ..... B65D 19/0014 108/57.25
9,745,100 B2 * 8/2017 Baltz ..... A47F 3/14
10,000,311 B1 * 6/2018 Oliver ..... B65D 19/0095
10,065,763 B2 * 9/2018 Wilcox ..... B65D 25/54
2003/0061974 A1 * 4/2003 Smyers ..... B65D 19/0012 108/56.1
2005/0145145 A1 * 7/2005 Ogburn ..... B65D 19/18 108/57.25
2006/0120820 A1 * 6/2006 Nyeboer ..... B65D 81/05 410/43
2006/0260976 A1 * 11/2006 Apps ..... B65D 19/18 206/600
2008/0066657 A1 * 3/2008 Kuo ..... B65D 19/18 108/57.19
2008/0236455 A1 * 10/2008 Naidu ..... F16B 21/086 108/56.1
2010/0154685 A1 * 6/2010 Arinstein ..... B65D 19/0018 108/57.16
2012/0304898 A1 * 12/2012 Dubois ..... B65D 19/0063 108/57.25
2012/0325125 A1 * 12/2012 Apps ..... B65D 19/0014 108/57.25
2016/0114936 A1 * 4/2016 Muirhead ..... B65D 19/0012 108/25
2020/0207512 A1 * 7/2020 Marconel Carpio ..... B65D 19/0093
2021/0331830 A1 * 10/2021 Huizingh ..... B65D 19/18

FOREIGN PATENT DOCUMENTS

DE 102014219398 A1 3/2016
EP 1354807 A2 10/2003
EP 2722285 A1 4/2014
ES 1073387 U 12/2010
WO 2010031465 A1 3/2010

* cited by examiner

PALLET MADE OF PLASTIC HAVING REINFORCING ELEMENTS

BACKGROUND OF THE INVENTION

The invention relates to a pallet consisting of plastic material according to the preamble of claim 1.

Pallets which are produced either from wood or from plastic material, in particular by means of injection-moulding, are known to be available on the market. The advantage of the wooden pallet resides in a certain robustness and in low production costs, but more and more wooden pallets are being replaced by pallets consisting of plastic material in particular for the transport and storage of high-quality goods. On the one hand, this is due to the fact that plastic material pallets are now constructed very robustly and in general are designed for very long operating periods and periods of use of 10 years and beyond and pallets consisting of plastic material become soiled to a much lesser extent in use because they can be easily cleaned quickly and thoroughly compared to wooden pallets.

The pallets are provided in different standard sizes, in particular in sizes of 800×1200 mm, 800×1000 mm, to name e.g. just some of the standard sizes. In particular, pallets which are referred to as half pallets and which purely by way of example have standard dimensions of 800×600 mm are also frequently used. These half pallets are suitable in particular for supplementing the standard pallets having a size dimension of 800×1200 mm.

A common aspect of the pallets is generally that they are formed having runners on the underside, by means of which the pallet stands on the floor surface. Typically, for pallets in the usual standard sizes three runners are used in each case which are arranged in parallel with one another and at a spaced intervals with respect to one another and in parallel with a pallet edge. In general, the two outer runners are arranged on two opposite pallet edges and the third runner is arranged in the region of the centre of the pallet. The adjacent runners on the underside of the cover plate of the pallet define between one another engagement openings which facilitate transport by means of typical lifting apparatuses. These engagement openings allow forks of forklift trucks or lift trucks to be driven underneath the cover plate of the pallet between the runners and thereby allow the pallet to be raised for transport purposes and then placed at the desired storage location by being lowered.

On the other hand, the runners are each arranged at a spaced interval from the cover plate in each case via support feet, wherein three support feet are typically used for each runner. These support feet also form between one another engagement openings for introducing forks of forklift truck or similar lifting apparatuses and so the pallet can also be grasped and transported on the narrow side by lifting apparatuses. In this respect, it is generally possible to pick up the pallet using conventional lifting apparatuses by the engagement of forks from all sides of the pallet.

The problem with transporting loaded pallets by means of motor-operated lifting apparatuses or hand-operated manual lift trucks is that the forks frequently strike against the runners as the lifting apparatuses are being driven under the pallet or under the top deck of the pallet, which, depending upon the active force or frequency of the strike or impact, can result in damage in the runner region of the pallets. This problem occurs in a particular manner especially in the case of pallets having reduced standard dimensions, i.e. particularly in the case of half pallets having e.g. standard sizes of 800×600 mm. The width of the two forks of the lifting apparatuses means that specifically for the outer support feet on the pallet edges only a small amount of play remains for the thickness of these support feet. That is to say, the smaller the standard size of the pallet, the less space or thickness available for the outer support feet which must be flush on the outer side with the pallet edges. This means that in particular in the case of pallets having small standard dimensions, such as for instance half pallets, the outer support feet must be comparatively thin or thin-walled, which gives rise to an increased risk of damage to the runners, i.e. the lower part of the pallet including the support feet, in these regions.

For this reason, wooden pallets are either strengthened e.g. on the outer surfaces with metal profiles or are formed overall from metal profiles which, however, is not the case with plastic material pallets. In this respect, it is particularly the ends of the support runners of plastic material pallets with the outer support feet arranged thereon which form weak points which are at a significant risk of breaking when lifting apparatuses are operated carelessly. This has resulted in the fact that plastic material pallets in these regions frequently consisting of hollow profiles are provided with inner reinforcements which, however, can ultimately also result in damage in the top deck when said pallets are struck.

The prior art discloses pallets consisting of plastic material, in which runners can be connected to the cover plate of the pallet via plug-in extensions and can be releasably fastened via latching elements such that in the event of damage to a runner, said runner can be completely replaced (DE 10 2014 219 398 A1). Furthermore, it is known (EP 2 722 285 A1) to provide pallets with bar-shaped stiffening elements in the runner region. The stiffening elements are inserted for this purpose into apertures of the runner and are fastened via lateral stabilisation elements in plate form which can be inserted into cut-outs of the runner. The fastening is effected in this case via latching hooks such that, in the event of wear, the stiffening elements of the runners can be replaced.

Reinforcing elements in runners of pallets are generally known, e.g. DE 10 2014 007 079 A1, wherein in this case the strip-like reinforcing elements placed in the runners are held and fixed by means of spring-elastic holding tongues. This prevents the reinforcing elements from rattling or the like within the receivers which are formed as channels.

Finally, it is known from DE 10 2009 042 552 A1 to integrate metal inserts into support runners of pallets, wherein the metal inserts are extrusion-coated with the plastic material of the pallet and are thus surrounded with a rigid plastic material shell. As a result, the reinforcing element is integrated into the runners as it were in one piece. All of these measures are comparatively expensive and do not allow for the situation where, for transport reasons, the engagement of lifting apparatuses causes damage to the runners which require replacement.

In this respect, the object of the invention is to provide pallets consisting of plastic material which eliminate the disadvantages of the prior art and permit runners which withstand heavy loads and in particular in a construction permitting replacement of damaged runners or runner components as a matter of course and thus permitting the continued use of non-damaged components.

SUMMARY OF THE INVENTION

According to the invention, the runner standing surface of a runner is divided preferably centrally transverse to the runner and moreover into at least two runner elements which are separate from one another. Of course, it is also within the scope of the invention to subdivide the runner standing surface into more than two runner elements. According to the invention, the subdivided runner elements combine to form a runner standing surface which is used for transferring the load of the goods on the pallet to the floor of the storage facility, on which the pallet stands with its runner standing surfaces. In a particularly advantageous manner, each runner element has a preferably elongated reinforcing element which, within the scope of the invention, is held in each case on its first end, remote from the dividing plane or the subdivision of the runner standing surface, by means of a stop in the runner element, and is held on its opposite second other end by means of the adjacent runner element without further measures. This holding, particularly in the mounted position, enables simple handling and completion of such a pallet. At the same time, in the event of damage to a runner it is possible to replace the damaged parts and e.g. the reinforcing element can be reused in a replacement part.

In an expedient manner, the stiffening element is received in each case in a channel within the runner element, thus readily enabling simple insertion of the reinforcing elements.

Within the scope of the invention, it is particularly advantageous that the channel is open towards the subdivision or the dividing plane. As a result, the reinforcing elements can be inserted quickly into the corresponding channels. If the runner elements which form the runner standing surface are then oriented with respect to one another such that on the end side they abut against the end side of the other runner elements, then the opening of the respective runner element is closed by means of the opposite runner element such that it is no longer possible for the inserted reinforcing elements to fall out. As a result, additional caps or the like can be dispensed with. At the opposite end, the reinforcing element is held in each case by means of a stop inside the runner, which can be achieved on the one hand by means of the runner itself in the course of an end face or by means of corner-side support feet with their end faces. Therefore, additional measures are not required for holding and fixing the inserted reinforcing elements.

In one expedient embodiment, the two channels of both runner elements are offset with respect to one another transverse to the runner in the case of a division into two in the runner elements. The reinforcing element is then held in the runner element by means of an end face of the other runner element in the dividing plane.

In an alternative embodiment, the two channels or reinforcing elements, in the case of a multiple division naturally of the plurality of runner elements, are oriented with one another in the longitudinal direction, wherein the reinforcing elements are then guaranteed to be held at the open region of the channels in each case by means of the inserted reinforcing element in the opposite runner element.

In an advantageous manner, the reinforcing element is formed by means of a strip having, in particular, a square or rectangular cross-section and in this connection it is expedient also to configure the cross-section of the channels in a complementary manner accordingly.

In an advantageous manner, the plurality of runners, in general three runners, are subdivided underneath the cover plate of the pallet in each case into a plurality of runner elements and, moreover, preferably each runner is subdivided into two separate runner elements which, in the mounted position on the pallet, then form the runner in each case. The consequence of this is that, when lifting apparatuses are handled carelessly and the pallet is damaged as a result, it is easily possible to replace the part, which on the one hand permits quick disassembly/assembly and also reduces material consumption of plastic material. It is within the scope of the invention to subdivide all of the runners of a pallet accordingly into multiple members, but it can also be expedient to subdivide into a plurality of runner elements only the particular runner which is arranged in the region e.g. of the narrow side of a pallet where damage can occur generally when a fork of a lifting apparatus is driven therein.

In an expedient manner, the runner of a pallet is installed specifically for this purpose, namely in that the runner as such in the mounted position has, on its two ends, angled end portions in the manner of support foot which form the runner support members which, together with further support feet on the underside of the cover plate of the pallet, hold the runners at a spaced interval with respect to the underside of the cover plate and define between one another or between themselves and the support feet on the underside of the cover plate of the pallet corresponding engagement openings for the engagement of forks of typical lifting apparatuses. That is to say that the angled runner support members provided on the ends of each runner assume the function of typical support feet on the underside of the cover plate of the pallet. In an expedient manner, the runner support members are formed on the ends of the runner standing surface of the runner, on the underside of which the pallet lies on the floor after being placed down by the lifting apparatus.

In a particularly expedient manner, the runner is subdivided into separate runner elements, in particular into a runner element pair, i.e. a subdivision of the runner into two runner elements. In an expedient manner, the subdivision or division is effected in the region of the runner standing surface, wherein, in the case of a central subdivision, in particular two runner elements are formed. They combine in the mounted position, optionally with the inclusion of the underside of a support foot of the pallet, to form a continuous runner standing surface.

In an expedient manner, the runner is releasably connected to the cover plate via the runner support members, wherein in an expedient manner the free end of each runner element opposite the corresponding runner support member is releasably connected to a support foot of the cover plate. If damage occurs in a runner region, e.g. as a result of careless handling of lifting apparatuses, then it is not e.g. the entire runner which has to be replaced but instead only the damaged part of the runner in the form of a separate runner element.

According to one development of the invention, the runner is divided transversely to the runner standing surface into at least two, but preferably two, runner elements and moreover in particular into two L-shaped runner elements, wherein the L-limb is formed by the runner support members and the L-web is formed by the corresponding runner standing surface of the runner element. By virtue of the fact that the runner support members are expediently identical to one another, a flush formation of the runner standing surface, in particular the underside thereof, is achieved after assembly of the runner elements.

The runner elements which each form one runner can be releasably connected via their runner support members to the cover plate by means of a form-fitting plug-in connection and/or optionally a latching connection. It is more expedient also to have a combination of a form-fitting plug-in connection and a latching clip which permits quick disassembly/assembly. The end of each runner element opposite the runner support member can have a latching lock provided thereon, via which the runner element at this end can be releasably connected to a support foot. However, this connection is established preferably by means of a separate mechanical fastening means. Quick-action lock screw bolts having a quick-action thread or in particular bolts having a bayonet lock are suitable for this purpose.

In the case of these fastening means, it is expedient that the typically radially further bolt head is received in a cut-out of the cover plate in a flush manner with the surface of the cover plate and the bayonet lock or screw lock of the bolt cooperates with the runner standing surface for locking purposes. However, an inverted formation is similarly also possible, i.e. anchoring of the bolt head from the underside of the runner standing surface with countersinking in the runner standing surface and fixing of the bolt in the region of the cover plate. Both variants are expedient.

In a particularly advantageous manner, in particular when one runner is divided up into two runner elements, it is expedient that the ends of the runner elements which are opposite the runner support member and which in the mounted position lie against one another to form the runner are provided with mutually vertically offset, mutually complementary and in particular annular receiving flanges for the fastening means. As a result, the ends of the runner elements engage one another in the mounted position, i.e. the receiving flanges of the two runner elements lie in an arrangement one above the other such that both runner elements can be anchored or fastened to the cover plate using one and the same fastening means. As a result, the runner as it were in the central region, i.e. in the central region of the runner standing surface, is fixed via a fastening means to the cover plate, in addition to the form-fitting and/or latching connection via the runner support members provided on the other ends of the runner elements. This has a very favourable effect for quick and easy disassembly of damaged components and assembly of replacement components.

Preferably, each runner element is connected to the cover plate via the support members by means of a form-fit, wherein in an expedient manner the runner element is held via a shoulder part which spans a cut-out for the engagement with the runner support member, in which the runner support member is held preferably only by means of a plug-in connection, in particular a form-fit connection. The runner element can then be mechanically fixed to the other end by virtue of a mechanical fastening means.

However, in an alternative embodiment it is also expedient that the ends of each runner element opposite the runner support members are connected and fastened separately via a fastening means independently of one another on a support foot to the cover plate. Although two fastening means are then required, this has the advantage that the runner elements can be identical to one another overall, i.e. only one and the same L-shaped runner element is required. In the case of this embodiment, in an advantageous manner the support foot of the cover plate arranged generally in the centre serves with its underside to form the continuous runner.

In both cases, it is expedient if the ends of the runner elements which are fastened to the support feet engage into complementary cut-outs of the support feet or are arranged therein such that a flush termination on the underside of the pallet can be easily ensured.

For the purpose of quickly connecting the runner elements, it is expedient that the runner support members can be fitted in a form-fitting manner into a complementary cut-out on the cover plate. However, in an expedient manner a clip-like latching lock can additionally also be provided, but this is not compulsory.

In general, the pallets are provided with three support feet for each runner region, wherein two of the support feet are formed according to the invention by means of the runner support members. In this respect, the ends of the runner elements opposite the runner support members are fastened in each case to the support foot, which is arranged accordingly in the centre of the cover plate, in an expedient manner via a mechanical fastening means. For assembly purposes, each L-shaped runner element is attached in this case in an oblique manner to the underside of the cover plate and is then pivoted downwards so that the clip-like locking or the form-fitting of the runner support members on the cover plate is then effected and then, after the runner elements are pivoted in the direction of the cover plate, the locking can be effected via the mechanical means.

In a particularly advantageous development of the invention, the runner elements are formed in a stiffened manner. A fibre-reinforced plastic material, e.g. by incorporating carbon fibres or glass fibres, or else the embedding of rigid stiffening elements, e.g. in the form of steel inserts or the like, are suitable for this purpose.

In an expedient manner, within the scope of the invention the cover plate with the support feet arranged in particular centrally and also the separate runner elements are each produced in one piece from plastic material by means of injection-moulding.

The term "pallet" used herein and in the claims is to be understood very broadly in terms of the invention and defines a load carrier which in a preferred case is formed in a planar manner only from one pallet having a planar cover plate without side walls, but also defines a load carrier, in which the pallet is integrated as a lower part and thus as a component of a large load carrier or large container. In this case of a load carrier for forming such a large container, the side walls which are arranged circumferentially extend upwards from the cover plate which then forms the base part of this container. This can be a rigid, i.e. non-foldable, side wall structure, in which optionally a folding cover can be provided in at least one side wall, or the side walls are articulated directly on the cover plate or on frame members, which are arranged thereon, in a foldable manner via hinges or the like.

In this respect, the term pallet includes such load carriers which are intended in particular for accommodating bulky goods.

In one particular development of the invention, the pallet as a load carrier forms the base part or the substructure of a large container, also called a large load carrier, by means of which the load carrier stands on the floor, wherein the containers are used in particular for accommodating bulky goods. These bulk containers which are also called large load carriers or large containers are constructed in the form of a container and have typical standard length and width dimensions e.g. from 800 mm×600 mm and up and frequently have pallet dimensions in surface area. In this embodiment, the pallet in accordance with the invention then forms as it were the load carrier by reason of an additional wall structure, wherein the cover plate of the pallet forms the base part of the large container or bulk container, respectively. In this case, it is expedient to arrange, in particular fasten in an articulated manner, the side walls of the large container on the cover plate of the pallet which then forms the base part of the container, which permits folding of the side walls to form a folding container.

This provides the advantage of this particular pallet formation in terms of the replacement of damaged structural elements also for pallet-like base parts of large containers or bulk container, respectively. Therefore, the invention also relates to large load carriers which are formed with a runner structure or runner standing surfaces according to at least one of claims 1 to 14.

BRIEF DESCRIPTION OF THE DRAWINGS

Exemplified embodiments of the invention will be described hereinafter purely schematically with the aid of the drawings.

DETAILED DESCRIPTION OF THE PREFERRED EMBODIMENTS

Figure 1:
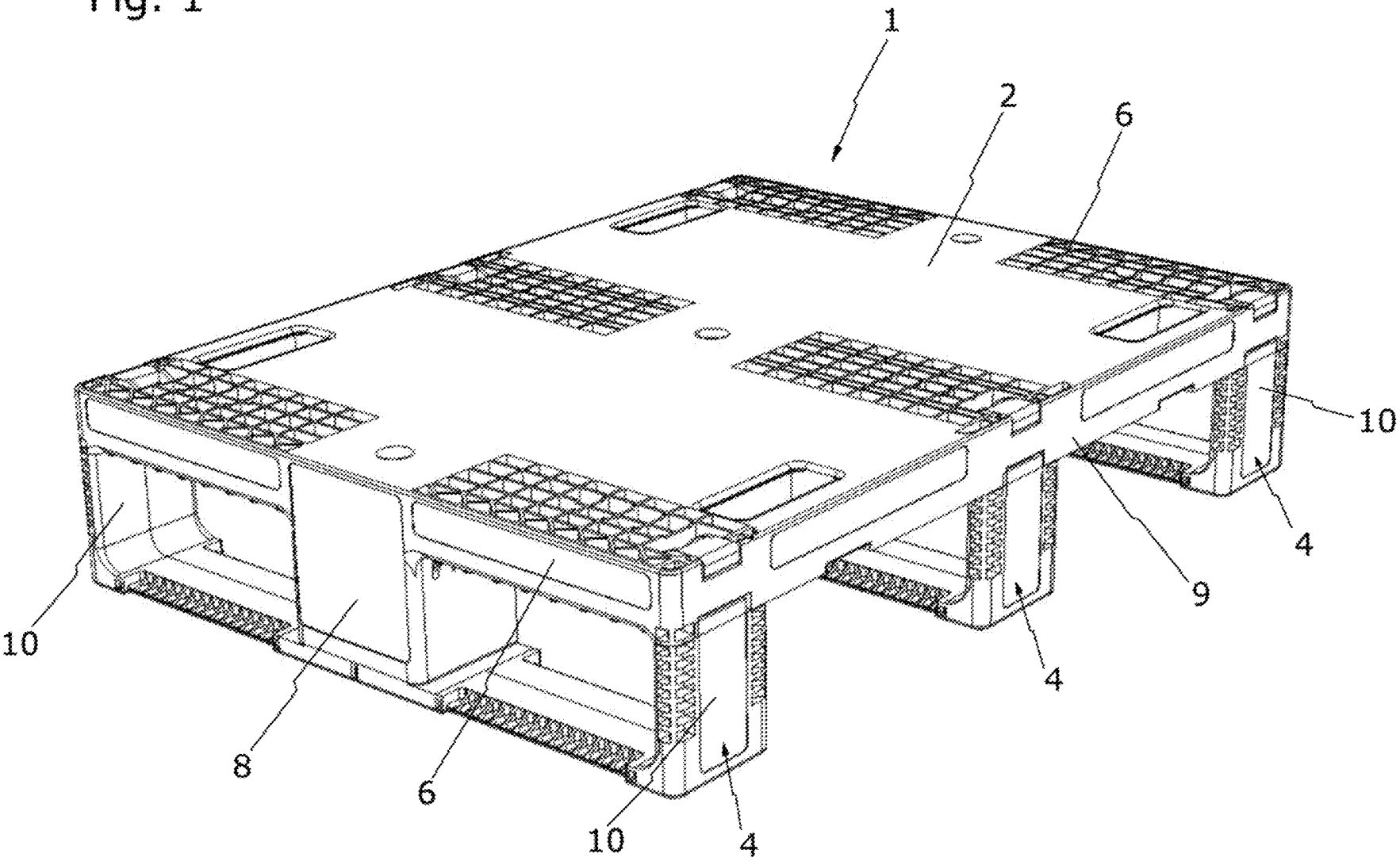
FIG. 1 shows a perspective view of an inventive embodiment of a pallet (viewed from above)

FIG. 1 shows an embodiment of the pallet in accordance with the invention in a view from above, wherein the pallet 1 has a cover plate 2 with a planar support surface which is used for transporting goods and products. Furthermore, in the illustrated exemplified embodiment the pallet 1 comprises three runners 4, in this case formed identically to one another, which are arranged in parallel with one another and in parallel with a side edge and thus as a result of the rectangular ground plot in parallel with the two opposite side edges 6. In the illustrated exemplified embodiment, the side edges 6 are the edges of the narrow side of the pallet.

Purely by way of example only, this is a so-called half pallet which is widely available on the market and—again only by way of example—has here for the purpose of illustration a pallet size of 800×600 mm. Of course, the invention can also be applied to any other standard sizes, e.g. 1200×1000 mm and the like.

Figure 2:
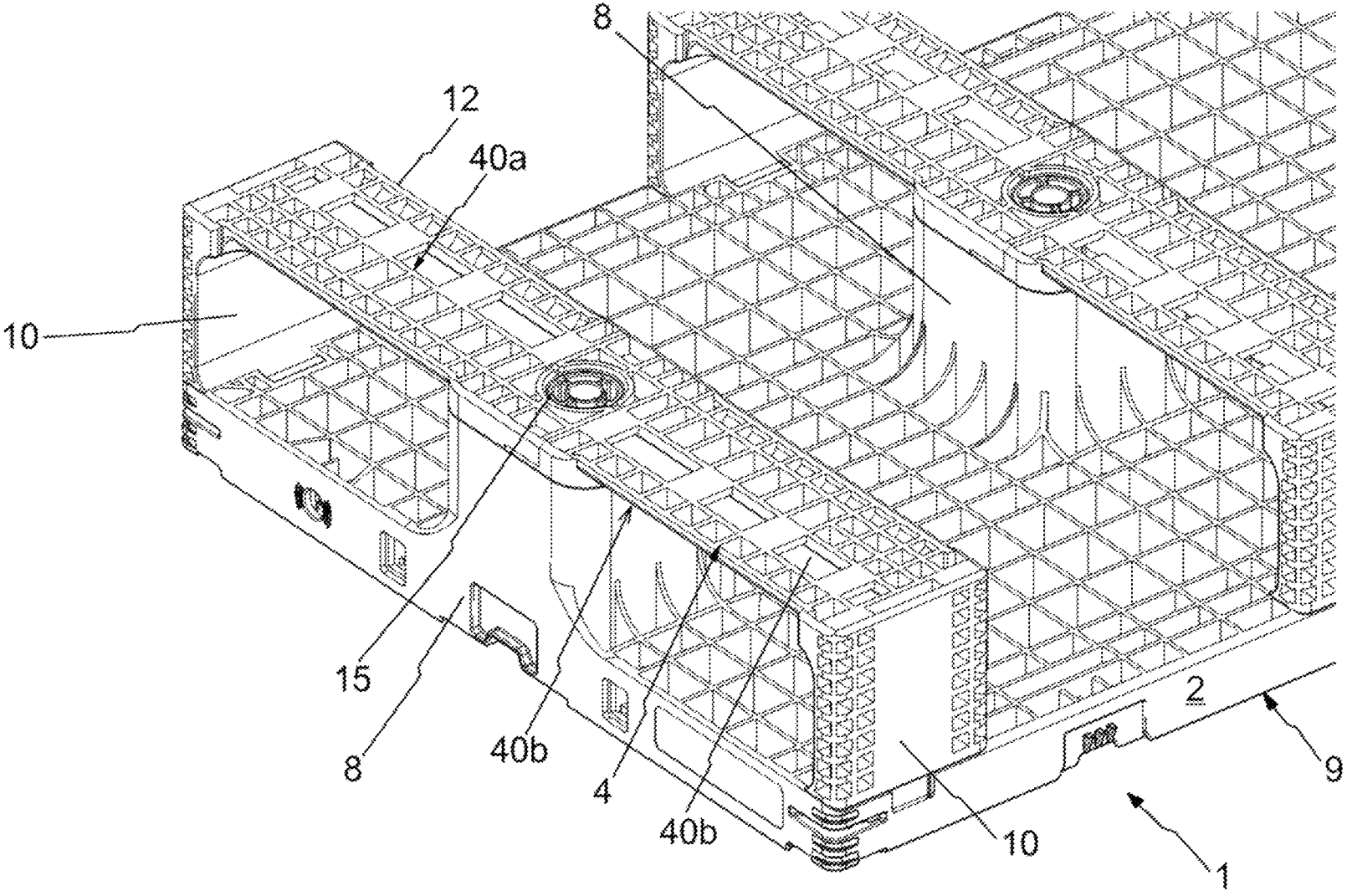
FIG. 2 shows a perspective partial view of the pallet as seen in a view from the bottom.

As is apparent from FIG. 2, the pallet has in particular three support feet 8 which are arranged centrally, i.e. along a central longitudinal axis of the pallet and by means of which the spaced interval between the lower part of the runners 4 and the pallet deck, i.e. the cover plate 2 of the pallet 1, is fixed. The runner 4 has at its two opposite ends in each case a runner support member 10 which is angled, in particular angled at a right-angle, formed in the manner of support feet and arranged on the longitudinal edges 9 of the pallet 1 at a spaced interval with respect to one another and in series with one another. These runner support members 10 also determine the spaced interval between the lower part of the runner 4 and the underside of the cover plate 2 of the pallet 1. As is clearly apparent from FIG. 2, the runner 4 has an elongated, strip-like runner standing surface 12 which has an underside located at the top in FIG. 2 by reason of the reversed view, with which normally in the correct rotational orientation the pallet is supported on the floor surface. In this case, the underside has not been designated by a reference sign.

As is clearly evident in FIG. 1, the two runner support members 10 of each runner 4 which are arranged on the narrow side define, with the centrally arranged support foot 8, between one another an engagement opening which is used for driving in forks of typical lifting apparatuses, e.g. forklift trucks or lift trucks or manual lift trucks. As a result, the forks can be introduced from the narrow side accordingly.

However, corresponding engagement openings are also provided on the longitudinal edges 9 of the pallet, wherein, in the illustrated exemplified embodiment, the runners 4 define between one another two engagement openings for lifting apparatuses. In the case of the embodiment shown in FIG. 2, each runner 4 is subdivided into two runner elements 4*a* and 4*b* in an advantageous manner centrally of the runner standing surface along a transversely directed separation plane 14, as is most clearly apparent from FIG. 3 and FIG. 4. Each of these runner elements can have an L-shaped structure, namely consisting of half a length of the runner standing surface and the angled runner support member 10 such that the runner support member is integrated in the runner element, which is not compulsory within the scope of the invention. Located at the free end of the runner support member 10 is a protrusion 15 which can be fitted preferably in a form-fitting manner into a complementary cut-out on the underside of the cover plate 2 and in an expedient manner, but not compulsorily so, can be releasably fastened by means of a suitable, in particular clip-like latching connection, which is the subject matter of German patent application 10 2017 121 18 13 included herein and therefore does not have to be described in greater detail.

Figure 3:
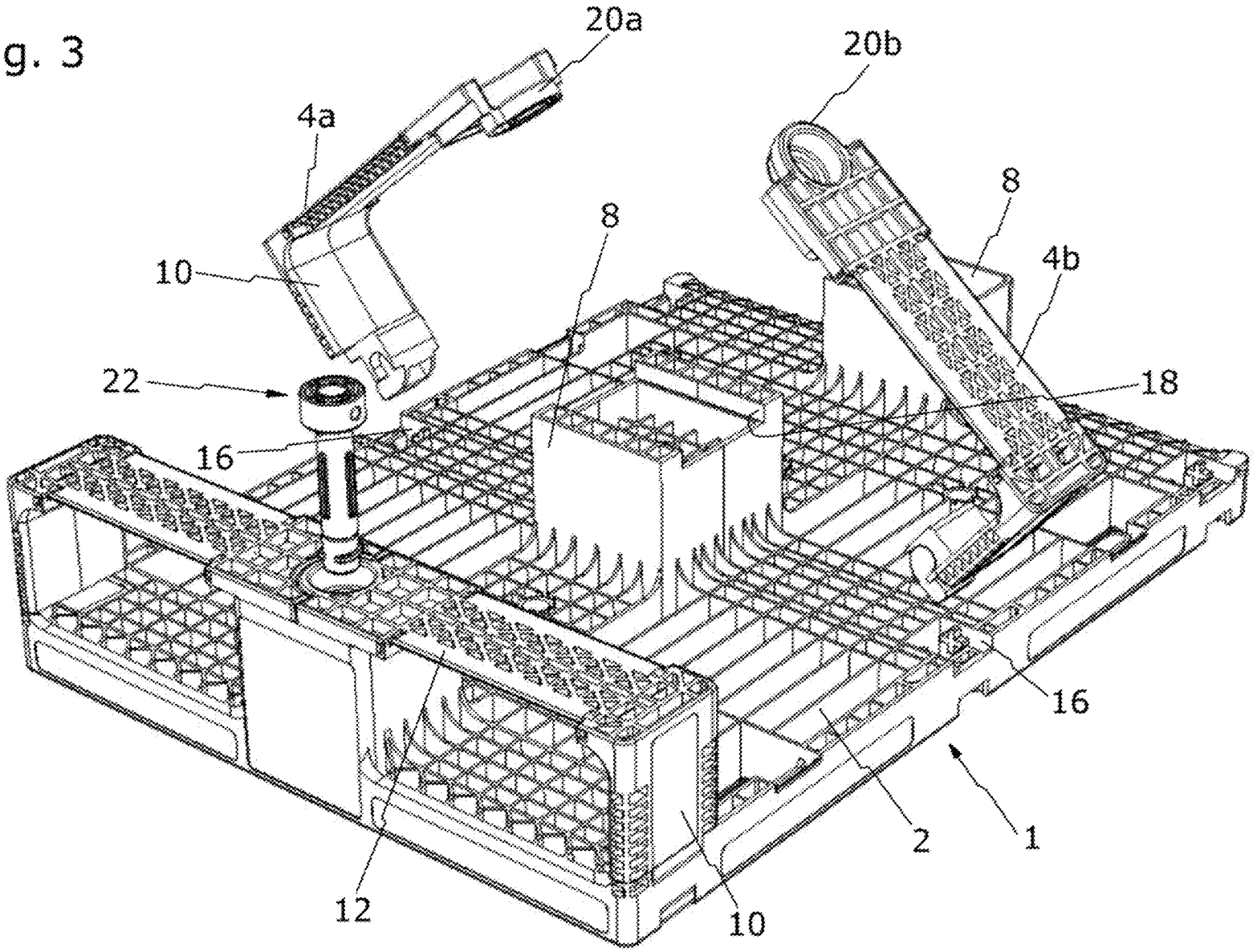
FIG. 3 shows a view of the pallet shown in FIG. 2 but in the functional position of individual structural elements, in this case without stiffening elements.

As is apparent from FIG. 3, each runner element can be attached for this purpose in an oblique manner to the underside of the cover plate so that the protrusion 15 can engage into the corresponding cut-outs 16. Each runner is then pivoted in the direction of the corresponding central support foot 8 and expediently engages at this location with its runner standing surface into a corresponding complementary cut-out 18 of the central support foot 8. In the case of latches, as the runner element 4*a* and 4*b* pivots in the direction of the cut-outs 18 the latching lug formed by the protrusion 15 snaps automatically into a corresponding latching-mimic of the underside of the cover plate in the region of the cut-out 16 and so the free end of each runner support member 10 can be latched with the underside of the cover plate 2.

The pivoted-in position is shown for the front runner in FIG. 3. In this case, at the free ends of the runner elements, flange-like, annular cut-outs 20*a* and 20*b*, which are vertically offset with respect to one another and are formed opposite the runner support members, lie coaxially on one another, thus producing an overall flush underside of the runner standing surface 12 of each runner 4 (cf. FIG. 4, foremost runner). In this position, in which the free ends of both runner elements 4*a*, 4*b* are arranged oppositely and expediently abutting one another, the flange-like receivers 20*a*, 20*b* lie on one another in the coaxial direction and so a suitable mechanical fastening means can be introduced which extends through a corresponding opening in the support foot 8 and can be releasably fastened by means of a corresponding fastening-mimic in the region of the top deck or the runner, not illustrated. As shown in FIG. 3, a suitable fastening means is a bolt 22 which is provided with a bayonet lock 24, illustrated in this case as a bayonet threaded portion. The bolt 22 has, at the other end, a radially expanded bolt head. Such bayonet bolts are known and do not have to be described in greater detail. In the embodiment shown in FIG. 3, the bayonet bolt 22 is inserted from the underside, wherein, however, it is also expedient to have an inverted arrangement in that the bolt can be introduced from the top side of the cover plate 2 into a corresponding receiver and then the bayonet-mimic on the bolt cooperates with a corresponding bayonet-mimic e.g. in the annular flange 20*b* of the runner element which, in the view from above shown in FIG. 3, lies coaxially on the annular receiving flange 20*a*. In both cases, both runner elements are releasably locked by means of a bolt to the top deck, in this case in the region of the central support foot.

It can be seen that in the event of damage to a runner element, it can be readily replaced quickly and easily with an undamaged new runner element. Only the bayonet lock has to be opened, the bolt taken out and the corresponding runner element then pivoted upwards as shown in the view in FIGS. 3 and 4 so that the free end of the runner support member is also unlocked from the top deck and the damaged runner element can be removed and replaced by a new one.

It is understood that the protrusion 15 with the latching mechanism is formed in each case such that it can be fitted in a flush manner into the cut-out 16 on the underside of the cover plate and thus terminates in a flush manner with the outer side and the underside of the cover plate. This is very clearly apparent from FIG. 1.

Figure 4:
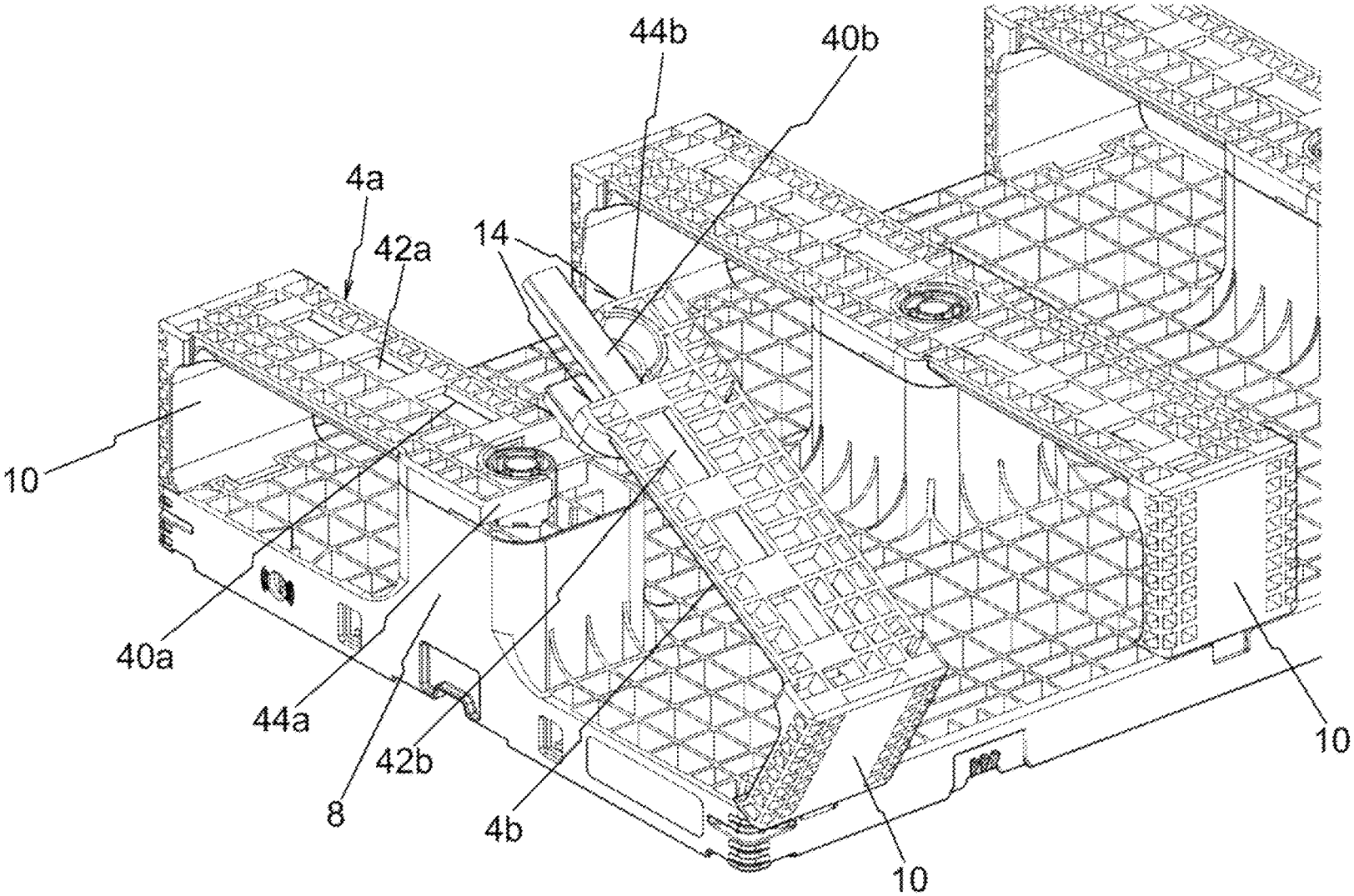
FIG. 4 shows a view of the pallet in the functional position similar to FIG. 3 but with insertable reinforcing elements.

It is to be noted that the design in accordance with the invention is illustrated in FIGS. 2 and 4, FIG. 3 merely serves to demonstrate, for the specific exemplified embodiment having L-shaped runner elements which at the same time form corner-side support feet 10, the arrangement or fastening thereof on/to the cover plate and the cooperation of the half-runner elements 4*a* and 4*b*.

The design of the invention shown in FIGS. 2 and 4 relates to the embedding or the integration of additional separate reinforcing elements 40*a* and 40*b* in the runner elements 4*a* and 4*b*. These reinforcing elements are formed preferably in the manner of strips and have preferably a rectangular or square cross-section, as is clear from FIG. 4.

It is to be noted that each runner element which, according to the inventive design, can also be formed without corner-side runner support members 10, has a reinforcing strip 40*a*, 40*b* which, as it were, is integrated in the runner standing surface and moreover preferably in each channel 42*a* and 42*b* of each runner element 4*a* and 4*b*. For the purpose of receiving the reinforcing elements 40*a*, 40*b* and each runner element 4*a* and 4*b*, each runner element preferably has channels 42*a*, 42*b* provided therein, into which the reinforcing strips 40*a*, 40*b* can each be inserted from the centre, i.e. the dividing plane 14. In this respect, the channels 40*a* and 40*b* are preferably open towards the dividing plane 14, facilitating the insertion of the reinforcing strips 40*a* and 40*b* into the respective channels 42*a* and 42*b* which are formed in particular having a complementary cross-section to the strips.

In an expedient manner, the channels 42*a* and 42*b* are delimited at their end remote from the dividing plane 14 by means of stops which limit the insertion of the reinforcing elements 40*a* and 40*b* and prevent same from falling out. In an advantageous manner, the stops are formed in this case by means of the end-side ends of the runner elements 4*a*, 4*b*, in FIG. 4 e.g. by means of the end sides of the corner support feet 10 and so as a result the reinforcing strips are easily prevented from falling out towards the outside. On the opposite side of the channels, i.e. the side directed towards the dividing plane 14, no corresponding stops are required, but instead after the mounted position has been achieved, as illustrated e.g. in FIG. 2, it is apparent that the inserted reinforcing elements within strips are delimited by the opposite end walls of the opposite runner element, here in the case of FIG. 4 the end-side surface 44*a* of the runner element 4*a* serves to delimit or act as a stop for the reinforcing element 40*b*. The same applies for the other reinforcing element 40*a*.

Since, in the case of the embodiment shown in FIG. 4 and also in the case of FIG. 2, the two reinforcing elements of the two runner elements are laterally offset with respect to one another, the reinforcing element 40*a* is similarly prevented from falling out by means of the end face of the runner element 42*b* illustrated in FIG. 4 only by one edge. That is to say that, in the folded-open position of the runner elements 4*a*, 4*b* apparent from FIG. 4, the reinforcing strips can easily be inserted comfortably and quickly into the corresponding channels or receivers and arrive at the end stop at the remote end of the dividing plane 14. If the runner elements are then folded downwards onto the central support foot element 8, then the reinforcing elements 40*a*, 40*b* received in the runner elements are correspondingly held automatically by the opposite runner elements, in this case by the end faces 44*a*, 44*b* thereof.

However, the offset arrangement of the reinforcing elements 40*a*, 40 as shown in FIGS. 2 and 4 is in no way compulsory and instead the reinforcing elements can also be oriented with one another in a direct longitudinal orientation, i.e. along a common axis. In this case, which is not illustrated in the figures, the reinforcing strips inserted into the channels would be prevented from falling out by virtue of the fact that the end sides of the reinforcing elements 40*a*, 40*b* come to lie against each other on the dividing plane.

By reason of this formation, the reinforcing elements are held very easily in the two runner elements and only at the end remote from the dividing plane are corresponding stops required which, however, can be formed by means of corresponding end walls, such as e.g. the end walls of support feet, whereas at the opposite end, i.e. in the region of the dividing plane, no additional measures are required.

If necessary, but certainly preferably, the holding of the reinforcing elements within the receivers or channels can be further reinforced by virtue of the fact that a very narrowly dimensioned plug-in fit is formed between the channel and the reinforcing strip. Alternatively, the walls of the channels can also have inwardly protruding, resiliently flexible holding tongues or ribs provided thereon which deform slightly in an elastic manner during insertion of the reinforcing strips and give rise to restoring forces which then ensure that the strips are held in a fixed manner and above all also in a fold-free manner within the channels. These measures are not illustrated in the figures.

It is to be noted that this design of the receiving and holding of reinforcing strips is not restricted to the described specific configuration of L-shaped runner elements, but instead, of course, can also be applied to runner elements without any support foot elements which form e.g. merely the runner standing surface and are divided accordingly. Although herein a central division is definitively described, it is at the discretion of the person skilled in the art to provide in this case also more than one dividing plane, e.g. two dividing planes, and so then three runner elements would be present which would be provided accordingly with three channels, thus making it also possible to produce the design of the invention.

Figure 5:
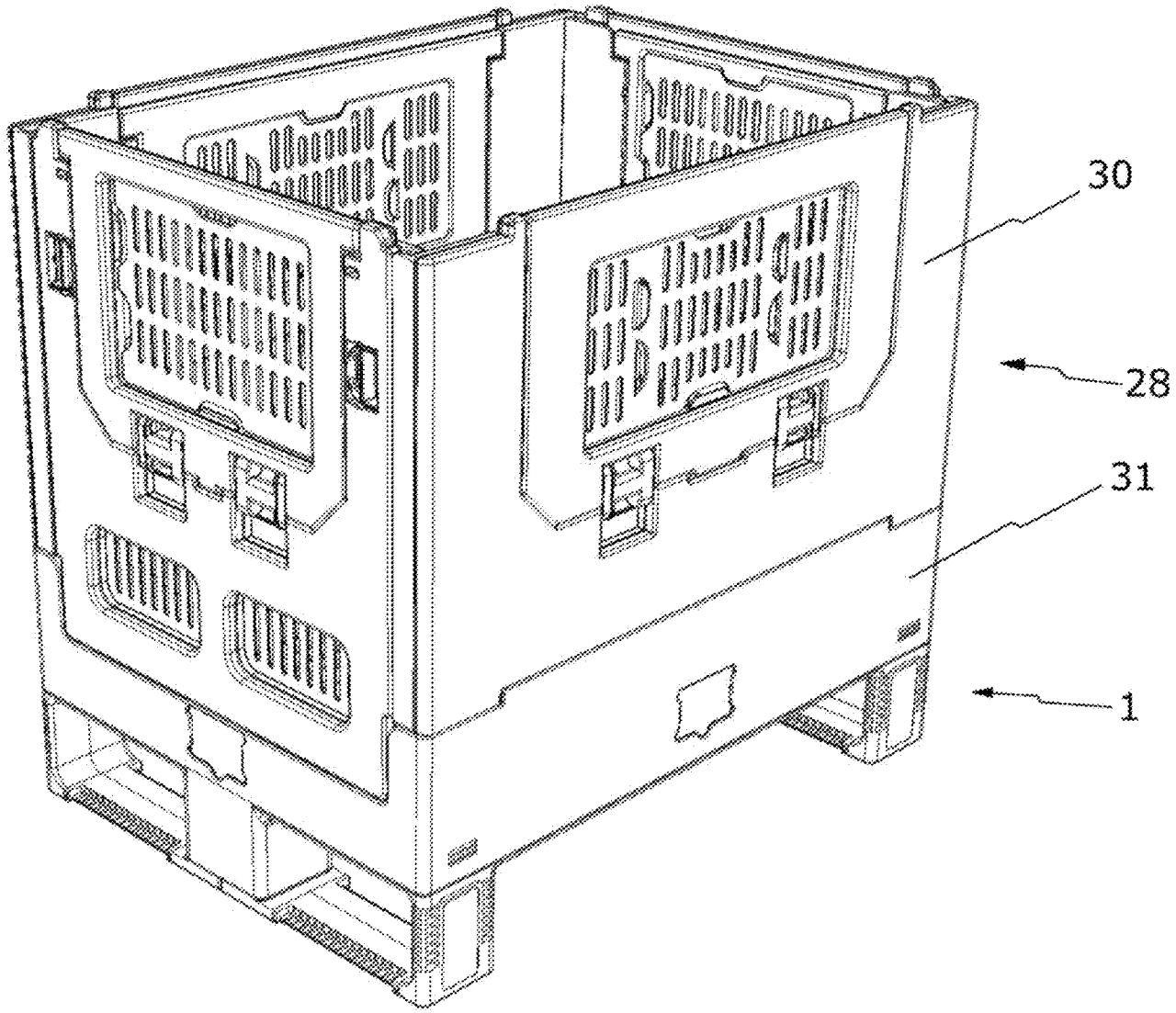
FIG. 5 shows a perspective view of the pallet in an embodiment as a base part of a large container or bulk container.

FIG. 5 shows the use of the pallet 1 as a base part of a large container 28, wherein the side walls 30 of the large container are connected preferably in a foldable manner to the corresponding sides of the cover plate 2 and thus as it were the pallet. That is to say that the particular embodiment of the pallet having the replaceable runner elements can also be used correspondingly and similarly for large containers. These large containers are generally known and have a pallet-shaped base lower part, on which the side walls 30 are arranged and in particular mostly in a foldable manner. In the illustrated exemplified embodiment, the side walls are preferably arranged on and articulated in particular in a foldable manner to frame members 31 of the base part formed as a pallet 1. The frame members 31 are arranged preferably on the circumference of the pallet. In the illustrated exemplified embodiment, the frame members 31 form part of the pallet, but this is not compulsory. They could also be connected separately to the base part of the pallet 1 by means of a latching or plug-in connection, but protrude upwards from the base part on the edge side circumferentially. From the base part to the upper edge of the side walls 30, the height of such large containers measures in the range of 80 to 110 cm and so a large-volume storage space for accommodating in particular bulky goods is possible. These large containers have pallet-like standard dimensions.

Figure 6:
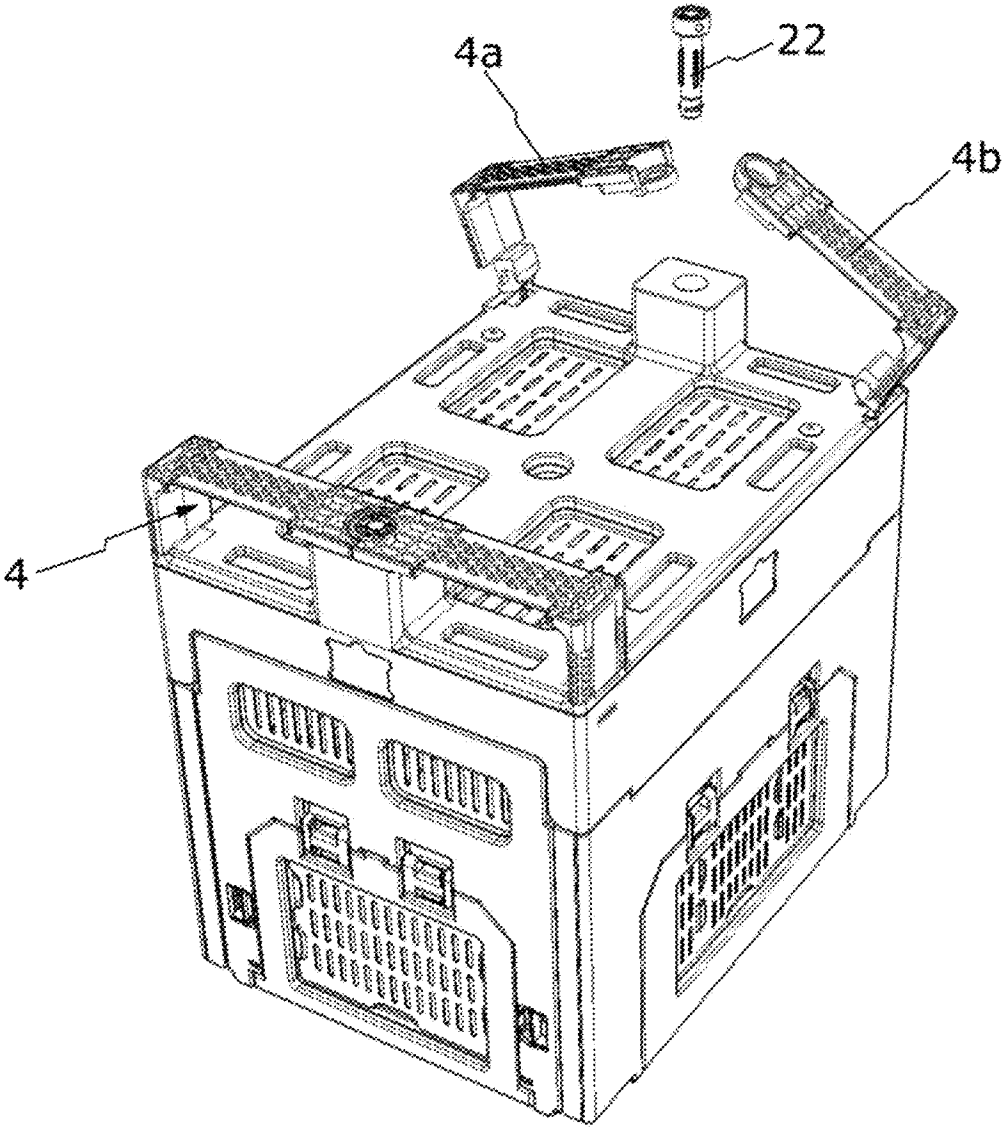
FIG. 6 shows a view of the embodiment of FIG. 6 [sic] but in the functional position and in the inverted position, i.e. with the arrangement of the base part at the top.

FIG. 6 shows the large container with the base upwards so that the runners 4 are visible. In the illustrated exemplified embodiment, the base part of the pallet 1 corresponds to the exemplified embodiment of FIGS. 1 to 4. The base part of the large container forms as it were the pallet 1 with the lower part in the form of runners and so the pallet illustrated with the aid of FIGS. 1 to 4 can be inserted and used accordingly as a base part of a large container.

As is apparent from FIGS. 5 and 6, in this exemplified embodiment the large container is fitted only with two runners 4 but this is shown by way of example only. If necessary, a central runner or further runners can also be provided, depending upon the size of the large container.

The invention claimed is:

1. A pallet comprising a plastic material, comprising:

a cover plate configured to accommodate articles; and at least two runners arranged underneath the cover plate, each runner including a runner standing surface;

wherein each runner standing surface is subdivided centrally of each runner transversely thereto at a dividing plane and into at least two separate runner elements including a first runner element and a second runner element, which, in the mounted position, combine to form the runner standing surface, and wherein each runner element includes an elongated reinforcing element which is held at a first end remote from the dividing plane by a stop in the first runner element and is held at a second end by the second runner element, and wherein the channels in the first and the second runner elements are offset with respect to one another transverse to the runner and the reinforcing element is held in the first runner element by an end face of the second runner element in the dividing plane.

2. The pallet as claimed in claim 1, wherein the reinforcing element is received in a channel of the runner element.

3. The pallet as claimed in claim 2, wherein the channel is open toward the dividing plane of the runners.

4. The pallet as claimed in claim 1, wherein each reinforcing element comprises a strip having a square or rectangular cross-section, wherein the channel for receiving the reinforcing element has a complementary cross-section, and wherein the reinforcing element comprises fibre-reinforced plastic material or metal.

5. The pallet as claimed in claim 4, wherein the at least one mechanical fastener comprises a bayonet bolt.

6. The pallet as claimed in claim 1, wherein each reinforcing element is fixed by a plug-in fit and/or by holding members protruding into the channel.

7. The pallet as claimed in claim 1, wherein the runner elements are each releasably connected to the cover plate of the pallet at a first end via the runner support members by a form-fitting plug-in connection and/or a clip-like latching connection, and wherein the runner elements are each connected at a second end opposite the first end to a support foot by a latching lock or at least one separate mechanical fastener.

8. The pallet as claimed in claim 1, wherein in the mounted position of first and second runner elements of each of the runners, the first end of each first and second runner element are received in complementary cut-outs on an underside of a corresponding support foot such that the underside of the runner standing surface and the corresponding support foot are flush with one another.

9. The pallet as claimed in claim 1, wherein the cover plate with a support foot is one piece, and wherein each runner element is one piece.

10. The pallet of claim 9, wherein the cover with the support foot and each runner element comprises an injection molded plastic.

11. The pallet as claimed in claim 1, wherein the pallet comprises a substructure of a load carrier which includes a side wall structure with circumferentially arranged side walls, wherein at least one of the side walls is configured to fold with respect to a supporting frame member.

12. The pallet as claimed in claim 11, wherein the cover plate of the pallet comprises the base part of the load carrier, and wherein side walls of the load carrier are configured to pivot with respect to side edge of the cover plate.

13. A load carrier, comprising:

a base part; and a side wall structure;

wherein the load carrier includes a base part that includes runner standing surfaces according to claim 1.

14. The pallet of claim 1, wherein the pallet includes three runners.

15. A pallet comprising a plastic material, comprising:

a cover plate configured to accommodate articles; and at least two runners arranged underneath the cover plate, each runner including a runner standing surface;

wherein each runner standing surface is subdivided centrally of each runner transversely thereto at a dividing plane and into at least two separate runner elements including a first runner element and a second runner element, which, in the mounted position, combine to form the runner standing surface, and wherein each runner element includes an elongated reinforcing element which is held at a first end remote from the dividing plane by a step in the first runner element and is held at a second end by the second runner element; and wherein the runners are arranged in parallel and at a spaced interval with respect to one another and in each case in parallel with a pallet edge, wherein on the end of each runner a runner support member is angled away from the runner standing surface of the runner in the direction of the cover plate and forms in each case a support foot arranged on the corner side of the pallet, wherein the runner standing surface of each runner is arranged by the runner support members and support feet, arranged therebetween, at a spaced interval with respect to the cover plate and is releasably connected thereto, wherein the first and second runner elements are releasably connected to the cover plate and in the position mounted on the cover plate form in each case one of the runners of the pallet, and wherein each runner element is L-shaped and the runner support member is angled at a right-angle from the runner standing surface of the runner element.

16. A pallet comprising a plastic material, comprising:

a cover plate configured to accommodate articles; and at least two runners arranged underneath the cover plate, each runner including a runner standing surface;

wherein each runner standing surface is subdivided centrally of each runner transversely thereto at a dividing plane and into at least two separate runner elements including a first runner element and a second runner element, which, in the mounted position, combine to form the runner standing surface, and wherein each runner element includes an elongated reinforcing element which is held at a first end remote from the dividing plane by a stop in the first runner element and is held at a second end by the second runner element; and wherein ends of the first and second runner elements which are opposite one another when the runner is in the mounted position include mutually vertically offset, complementary, annular receiving flanges for the at least one separate mechanical fastener, which, in the mounted position, are arranged lying one on top of the other such that the undersides of the runner standing surfaces of the runner elements are flush, and wherein the first and second runner elements are configured to each be releasably locked to a support foot by the at least one separate mechanical fastener.

* * * * *